United States Patent [19]

Tebbe

[11] Patent Number: 5,044,421

[45] Date of Patent: Sep. 3, 1991

[54] ROTARY PNEUMO-HYDRAULIC CLAMP

[76] Inventor: Joseph J. Tebbe, St. Paul, Minn.

[21] Appl. No.: 559,711

[22] Filed: Jul. 30, 1990

[51] Int. Cl.[5] ..... B22D 29/00

[52] U.S. Cl. ..... 164/401; 279/1 S; 279/4; 279/38; 279/107

[58] Field of Search ..... 279/38, 39, 40, 107, 279/4, 1 S, 1 J; 164/401; 409/231, 232, 233, 234; 408/239, 239 F, 240

[56] References Cited

U.S. PATENT DOCUMENTS 895,438 8/1908 Delany ..... 279/38

FOREIGN PATENT DOCUMENTS 483102 1/1973 Japan ..... 279/38

*Primary Examiner*—Z. R. Bilinsky

[57] ABSTRACT

A rotary clamping device is used to clamp an investment casting within a cleaning center to permit cutting and cleaning of the investment from the casting. The clamping device includes a piston and cylinder unit which is advanced to shift a clamping assembly into clamping relation with an investment casting, and is retracted to release the clamping assembly. Hydraulic pressure is used to advance piston rod of the piston and cylinder unit, and pneumatic pressure is used to retract the piston rod. Rotary drive means are connected to the clamping device for selectively rotating the same in clockwise and counterclockwise directions.

5 Claims, 1 Drawing Sheet

ROTARY PNEUMO-HYDRAULIC CLAMP

FIELD OF THE INVENTION

This invention relates to a rotary pneumo-hydraulic clamp for clamping investment castings for cleaning.

BACKGROUND OF THE INVENTION

Investment casting foundries form cast components which require removal of the investment by cutting and cleaning operations. The investment casting is placed in a cleaning center and the major portion of the investment is removed or cut by high pressure jets of water. Final cleaning of the investment is done with high pressure water jets. A clamping device is required to clamp and hold the investment casting during the cutting and cleaning steps.

SUMMARY OF THE INVENTION

An object of this invention is to provide a novel clamp device for use in cleaning investment castings which is operable for clamping and holding a casting within a one second time frame, and which is operable for releasing the cleaned casting within a one second time frame.

Another object of this invention is to provide a novel clamp device including means for rotating the clamping device in a clockwise and counterclockwise direction to permit effective cleaning of the casting.

A further object of this invention is the provision of a clamp device which is capable of holding the casting rigid while the casting is cleaned or investment cut with high pressure jets of water.

Another object of this invention is to provide a novel clamp device for cleaning investment castings which permits a single operator to load, clamp, release and unload the casting without fatigue to the operator.

In carrying out the invention, the novel clamp includes a piston and cylinder assembly connected to a gripper claw assembly. The piston is advanced in a clamping direction by high pressure hydraulic fluid and is retracted in a releasing direction by pneumatic pressure. The gripper claws of the gripper claw assembly are cammed into clamping relation with a casting by a claw actuator camming ring. The clamping device is connected to a reversible rotary power means for rotating the device in either a clockwise or counterclockwise direction to permit effective cleaning of the casting.

FIGURES OF THE DRAWING

FIG. 2 is a diagrammatic view of the interior of a cleaning center illustrating the novel clamp device in clamping relation with a casting, and FIG. 1 is a diagrammatic sectional view of the novel clamping device illustrating the various components thereof.

DESCRIPTION OF THE PREFERRED EMBODIMENT

Figures 1, 2:
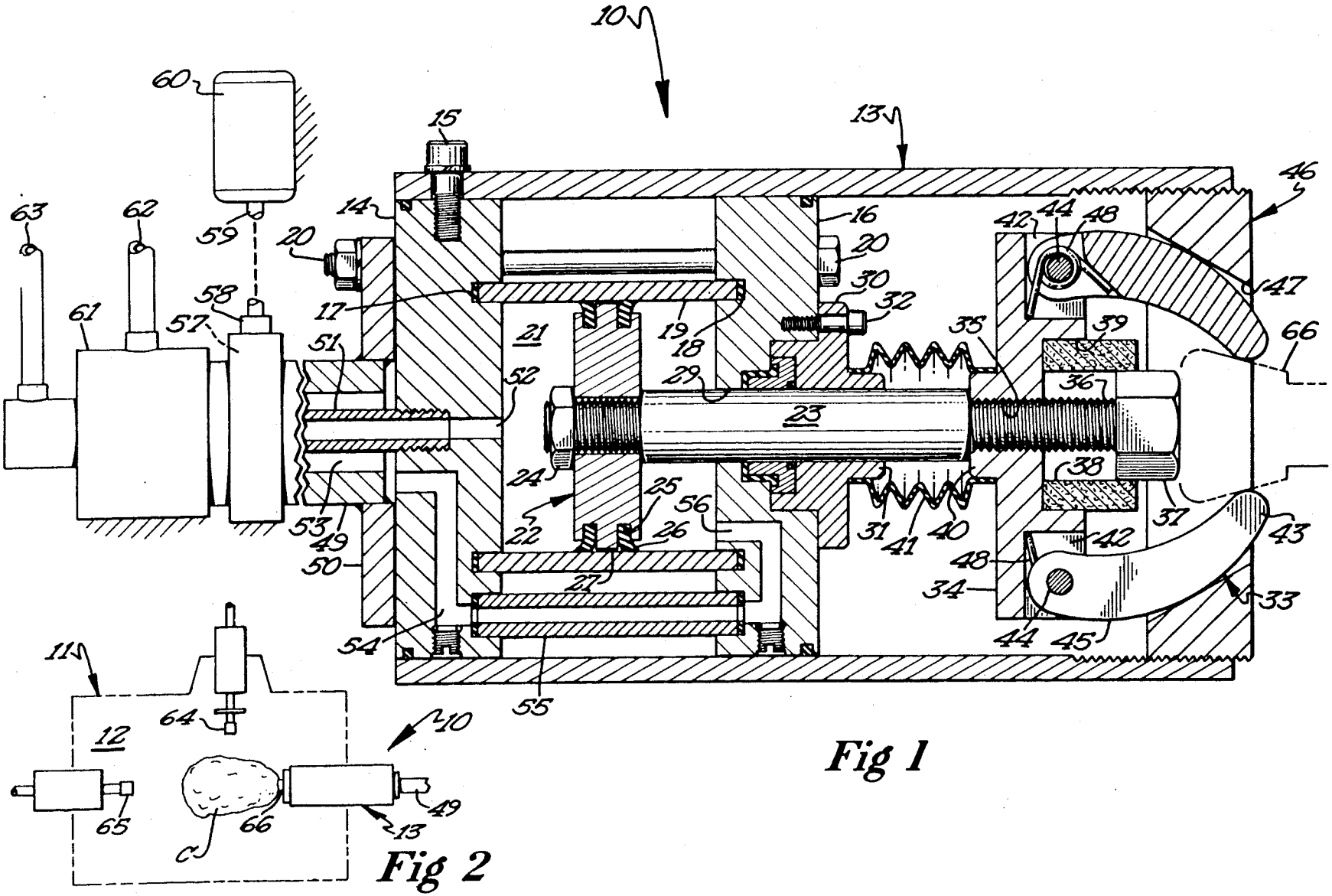

Referring now to the drawings and more specifically to FIG. 2, it will be seen that the novel clamping device, designated generally by the reference numeral 10, is illustrated in mounted relation within a cleaning center structure 11. The cleaning center structure 11 has an interior chamber 12 in which the investment casting is cleaned. It will be seen that the clamping device 10 is mounted in a vertical wall of the cleaning center structure and projects interiorally thereof.

Referring now to FIG. 1, the clamping device 10 includes an elongate external cylindrical jacket 13 formed of a rigid metallic material such steel or the like. The cylindrical jacket has its rear end closed by a rear base cap 14 which is rigidly secured to the cylindrical jacket 13 by suitable bolts 15. A front cap 16, axially spaced forwardly of the rear base cap 14, is fixedly mounted within the cylindrical jacket 13. It will be noted that the front face of the rear base cap 14 has an annular groove 17 therein while the rear face of the front cap 16 has an annular groove 18 therein. These grooves are disposed in spaced apart confronting relation and accommodate the ends of an elongate cylindrical sleeve 19. Suitable nut and bolt assemblies secure the rear base cap 14, front cap 16 and cylindrical sleeve 19 together.

The rear base cap 14, front cap 16 and cylindrical sleeve 19 cooperate with each other to define a cylinder having a hollow cylindrical chamber 21 of a piston and cylinder piston unit. A piston 22 is positioned within the cylinder chamber 21 and is axially movable therein in response to hydraulic and/or pneumatic fluid pressure. An elongate piston rod 23 is secured to the piston 22 and is movable therewith. It will be noted that the piston rod 23 is rigidly secured to the piston 22 by a jam nut 24 and projects forwardly therefrom.

The piston 22 has a pair of axially spaced apart, outwardly facing annular recessess 25 therein. Each recess 25 receives an annular, flexible seal 26 therein. The seals 26 extend outwardly into engaging relation with the inner surface of the cylindrical sleeve 19 to form fluid seals thereat. It will be noted that the central portion 27 of the piston 22 extends radially outwardly beyond the remaining circumferential surface of the piston.

It will be noted that the front cap 16 has an seal plate 30 secured thereto by bolts 32. This seal plate 30 also has a reduced end portion 31 integrally formed therewith and projecting forwardly therefrom. The piston rod 23 projects through an opening 29 in the front cap 16 and the seal plate 30 and has a clamping assembly 33 mounted on its front end portion.

The clamping assembly 33 includes a claw retainer plate 34 of circular configuration having a centrally located internally threaded opening 35 therein. The claw retainer plate 34 threadedly engages the externally threaded end 36 of the piston rod 23. A saddle nut 37 threadedly engages the front end of the piston rod 23 and serves as an adjustable stop nut. A rubber seal 38 within an annular recess 39 in the claw retainer plate 34 serves to protect externally thread end 36. It will be noted that the claw retainer plate 34 has a reduced rear end portion 40. A bellows type seal 41 is secured to and extends between the reduced end portion 40 of the claw retainer plate and the reduced end portion 31 of the seal plate 30. The bellows seal 41 serves to protect piston rod 23 from water or abrasives during the cleaning and cutting operations.

The claw retainer plate 34 also includes a plurality of circumferentially spaced apart recesses 42 therein each accommodating one end of one of a plurality of elongate curved claws 43. It will be seen that each of the elongate curved claws is pivotally connected at one end thereof to the claw retainer plate 34 in one of the recesses by a pivot 44 which permits the claws to pivot inwardly in a clamping direction and outwardly in a release direction. In the embodiment shown, there are three claws provided and are spaced approximately 120 degrees apart.

Each of the elongate curved claws has an outer curved cam follower surface 45 which is disposed in engaging relation with a claw actuator cam ring 46. In this regard, it will be noted that the cam ring 46 is threadedly secured to the inner surface of the external cylindrical jacket 13 at the forward end thereof. The claw actuator cam ring 46 has a forwardly and inwardly tapering cam surface 47 which engages the outer cam follower surface 45 of each claw 43. Each claw is provided with a torsion spring 48, these springs normally urging the claws against the camming surface 47 of the claw actuator cam ring 46.

During the cleaning operation, the clamping device 10 must be capable of rotating in a clockwise as well as a counterclockwise direction in order to assure effective and complete cleaning of the castings. Therefore means are provided for rotating the entire clamping device during the cleaning and cutting operation. This means include an elongate hollow drive shaft 49 which has one end thereof rigidly secured to an annular plate 50. The annular plate 50 is secured to the outer or rear surface of the rear base cap 14 by means of the nut and bolt assemblies 20.

The hollow drive shaft 49 is provided with a hydraulic fluid supply tube 51 which is positioned interiorally thereof and which threadedly engages a threaded opening 52 in the rear base cap 14. The opening 52 defines a port that intercommunicates the hydraulic fluid supply tube 51 with the cylinder chamber 21. It is pointed out that the hydraulic fluid supply tube 51 is connected to a source of hydraulic fluid under pressure. Thus it will be seen that when the hydraulic fluid is supplied to the tube 51, the piston 22 and piston rod 23 will be moved in a forward or advanced direction.

The interior 53 of the hollow drive shaft 49 also serves as an air supply conduit for supplying air under pressure into the cylinder chamber 21 for retracting the piston 22 and piston rod 23. In this regard, it will be noted that the interior 53 of the hollow drive shaft 49 is connected in communicating relation with an air passage 54 formed in the rear base cap 14. The air passage 54 communicates with an air passage tube 55 which is positioned internally of the external cylindrical jacket 13 but externally of the sleeve 19. The air passage tube 55 is connected in communicating relation to an air passage 56 in the front cap 16 so that air under pressure when passing through the hollow drive shaft 49 will be supplied to the chamber 21 to produce retraction of the piston and piston rod.

It is pointed out that during retraction of the piston and piston rod the high pressure hydraulic fluid in the cylinder chamber 21 will be relieved or vented to atmosphere permitting the air under pressure to displace the hydraulic fluid and cause the hydraulic fluid to bleed back into the reservoir (not shown).

The means for rotating the clamping device 10 in a clockwise or counterclockwise direction includes a gear reduction unit 57 mounted on the hollow drive shaft 49 and drivingly connected with a drive connection element 58 mounted on the output shaft 59 of a reversible electric motor 60. Suitable controls are provided for operating the motor 60 to permit selective operation in either a clockwise or counterclockwise direction.

The hollow drive shaft 49 is also connected to a dual rotary union mechanism 61 which is connected by a conduit 62 to a source of air under pressure. The union 61 is also connected by a conduit 63 to an hydraulic pump (not shown) for pumping hydraulic fluid under pressure to the clamping device. It is pointed out the union may be any of the typical commercial dual unions which remain stationary but permits rotation of the hollow drive shaft 49 relative thereto.

Referring now to FIG. 2, it will be seen that the cleaning center structure 11 has a cleaning nozzle 64 mounted in one of the vertical walls thereof and having its discharge orifice facing inwardly. Similarly, a cutting nozzle 65 is mounted in the adjacent wall of the cleaning center structure and has its discharge orifice facing inwardly. When it is desirable to remove the investment from an investment casing, an operator will place the casting within the cleaning center structure and will actuate the clamping device 10 by suitable controls (not shown) to advance the piston and piston rod in response to high pressure hydraulic fluid entering the cylinder chamber 21 via the hydraulic fluid supply tube 51. As the piston rod 23 is advanced, the outer curved cam follower surfaces 45 of the claws 43 will co-act with the cam surface 47 to progressively cam claws toward the clamping position. The operator will have placed the pouring cup 66 of the casting C so that end of the pouring cup engages the adjustable stop nut 37. The curved clamping claws 43 will be cammed into clamped relation with the pouring cup in preparation of the cutting and cleaning operation.

High pressure water will be directed against the casting C to cut the investment from the casting during the cutting step. During the cutting operation, the controls will be actuated to rotate the clamping device selectively in a clockwise or counterclockwise direction to assure efficient and complete cutting of the investment from the casting. After the cutting step is completed, the cleaning nozzle 64 will be actuated to direct high pressure jets of water against the casting C to clean any remaining residual investment from the C. It is pointed out that during the cutting and cleaning steps, high pressure water will be discharged from the cutting nozzle 65 or the cleaning nozzle 64 at a pressure of approximately 11,500 psi. During both the cutting step and the cleaning step, rotation of the clamp will have a low angular velocity as a result of the motor 60 and gear reduction unit 57. In the embodiment shown, there is a gear reduction of a 100 to 1 with the rotational speed of the clamping device at an angular velocity of from 0 to 17.5 rpms.

After the cleaning step, when it is desirable to remove the cleaned casting from the cleaning center structure, the operator will again manipulate the controls to introduce air under pressure into the chamber 21 on the front side of the piston 22 of the clamping device. Simultaneously, the hydraulic pressure exerted by the hydraulic fluid on the piston 22 will be relieved or vented to air thereby permitting the hydraulic fluid to bleed from the chamber back into the hydraulic fluid reservoir (not shown) as air pressure shift the piston and piston rods in a retractive and jaw release direction.

The torsion springs 48 will slowly urge the jaws in an outward or release direction as the piston rod is retracted. The casting will be released by the clamping device and the operator may remove the casting and actuate the clamping device to grip a new casting to be cleaned.

The actuation time for clamping a new casting takes approximately one second and the release of a casting takes approximately one second. With the arrangement, it has been found that the effort involved by an operator to clamp a casting, release a casting, remove a casting, and begin the cycle anew, involves a minimal effort and is not fatiguing to the operator. It has also been found that the novel clamping device can withstand continuous exposure to high pressure water jets and during the cutting or cleaning operations without and appreciable wear or damage.

Although high pressure water jets are used to clean the casting, in some instances abrasive entrained water jets may be used to clear certain investments from the castings.

From the foregoing it will be seen that I have provided a novel clamping device which is not only of simple and inexpensive construction and operation, but one which functions in a more efficient manner than any heretofore known clamping device used in the investment casting industry.

What is claimed is:

1. A rotary clamping device for use in clamping an investment casting in a closed cleaning center for removal of the investment from the casting by high pressure water jets, the investment casting having pouring cup at one end thereof, comprising, a cylinder having a piston chamber, a piston positioned within and axially movable in said chamber, a piston rod secured to said piston and projecting from said chamber and being extensible and retractable relative to said chamber, a clamping assembly secured to said piston rod and shiftable therewith and including a claw retainer plate, a rigid, adjustable stop member secured to the end of said piston rod, a plurality of elongate, longitudinally curved clamping claws, each claw having longitudinally curved inner and outer surfaces, means pivotally mounting each claw on said claw retainer plate for pivotal movement relative thereto between an outward release position and an inward clamping position, each of said claws having a cam follower surface, a plurality of resilient elements each engaging one of said claws to normally urge each claw in an outward release direction, a claw actuator cam ring, means connecting said cam ring with said cylinder, said cam ring engaging the cam follower surfaces of said claws whereby when the pouring cup of an investment casting is positioned in engaging relation with said rigid stop member and said piston rod is extended, said claws will be cammed into clamping relation with the pouring cup of an investment casting to rigidly immovably capture and clamp the pouring cup against the rigid stop member, and when said piston rod is retracted, each of said claws will be urged to the release position by one of said resilient elements, passage means connected in communicating relation with said chamber on one side of said piston and connected to a source of hydraulic fluid under high pressure for extending said piston rod, passage means connected in communicating relation to said chamber on the other side of said piston and connected to a source of air under pressure for retracting said piston rod, and rotary drive means connected with said clamping device and a reversible rotary power means for selectively rotating said clamping device in either direction.

2. The clamping device as defined in claim 1 and an external cylindrical jacket positioned externally around and rigidly connected with said cylinder and enclosing said piston rod, clamping assembly and cam ring.

3. The clamping device as defined in claim 2 wherein said claw actuator cam ring is positioned within said cylindrical jacket adjacent one end thereof.

4. The clamping device as defined in claim 1 wherein the curved exterior surface of each claw defines the cam follower surface for each claws.

5. The clamping device as defined in claim 1 wherein said clamping assembly includes three claws spaced equidistant apart on said retainer plate, each of said claws engaging the pouring cup of an investment casting with point contact when the piston rod is in the extend position.

* * * * *